United States Patent [19]

Maya et al.

[11] Patent Number: 5,021,718

[45] Date of Patent: Jun. 4, 1991

[54] NEGATIVE GLOW DISCHARGE LAMP

[75] Inventors: Jakob Maya, Brookline, Mass.; Joseph D. Michael, University Heights, Ohio; Radomir Lagushenko, Brookline, Mass.

[73] Assignee: GTE Products Corporation, Danvers, Mass.

[21] Appl. No.: 473,511

[22] Filed: Feb. 1, 1990

[51] Int. Cl.[5] ..... H01J 17/00

[52] U.S. Cl. ..... 315/358; 313/619; 313/638; 313/643

[58] Field of Search ..... 315/94, 105, 358; 313/619, 637, 638, 643

[56] References Cited

U.S. PATENT DOCUMENTS

| | | | |
|---|---|---|---|
| 4,413,204 | 11/1983 | Byszewski et al. | 313/491 |
| 4,431,945 | 2/1984 | Kawashima et al. | 313/619 X |
| 4,441,045 | 4/1984 | Sprengers | 313/25 |
| 4,450,380 | 5/1984 | Proud et al. | 313/485 |
| 4,494,046 | 1/1985 | Budinger et al. | 315/260 |
| 4,516,057 | 5/1985 | Proud et al. | 315/260 |
| 4,518,897 | 5/1985 | Proud et al. | 315/260 |
| 4,521,718 | 6/1985 | Byszewski et al. | 315/99 |
| 4,836,816 | 6/1989 | Bouchard et al. | 445/51 |

OTHER PUBLICATIONS

Introduction to Electrical Discharges in Gases by Sanborn C. Brown, Massachusetts Institute of Technology, Chapter 13, pp. 211–221.

*Primary Examiner*—Robert J. Pascal

*Attorney, Agent, or Firm*—Carlo S. Bessone

[57] ABSTRACT

A negative glow discharge lamp including a light transmitting envelope having supported therein electrode means for establishing a negative glow discharge in the lamp. The fill material includes a metal-based gas such as sodium which, upon excitation thereof, directly emits visible light. The sodium has a resonance radiation in the visible part of the spectrum. The cathode is a hot cathode.

14 Claims, 1 Drawing Sheet

NEGATIVE GLOW DISCHARGE LAMP

TECHNICAL FIELD

The present invention pertains in general to negative glow discharge lamps and relates, more particularly, to a negative glow discharge lamp that employs a sodium fill which emits visible light upon excitation.

BACKGROUND OF THE INVENTION

Most negative glow discharge lamps typically employ a mercury fill material which emits ultraviolet radiation upon excitation, in combination with a noble gas such as neon. The ultraviolet radiation is then converted into visible light by a phosphor coated envelope. The following are typical samples of mercury negative glow discharge lamps disclosed in the prior art: U.S. Pat. Nos. 4,521,718; 4,518,897;4,516,057; 4,494,046; 4,450,380; 4,413,204. Among other things, it is noted that with lamps of this type there is energy loss associated with the aforementioned conversion process and an inefficient energy transfer results.

In addition to the aforementioned mercury glow discharge lamps, the prior art also discloses a low pressure sodium lamp. These lamps operate in the positive column regime and one drawback associated with these lamps is that they only discharge yellow light within the visible spectrum due to the use of low energy excitation electrons. Thus, a very narrow spectral arrangement exists with these lamps and they are not generally effective in providing "white" light.

In the book "Introduction to Electrical Discharges in Gases" (Wiley & Sons, 1966, N.Y.) by Sanborn C. Brown, in Chapter 13 thereof under "Glow Discharges" there are described certain parameters relating to glow discharge lamps. They describe the color of the negative glow regime of a sodium discharge as being "whitish." This book suggests the use of sodium in a glow discharge lamp only in connection with cold cathode operation. These lamps are characterized by a relatively narrow spectral response.

OBJECTS OF THE INVENTION

Accordingly, it is an object of the present invention to provide a negative glow discharge lamp characterized by a more efficient transfer of energy. In particular, it is an object of the invention to eliminate the need for the conversion of ultraviolet radiation to visible light in a negative glow discharge lamp.

Another object of the present invention is to provide a negative glow discharge lamp which employs a preferred sodium fill so as to produce a broad spectral output, supported around the cathode in the so-called negative glow region of the discharge lamp.

A further objection of the present invention is to provide a negative glow discharge lamp having a hot cathode and characterized by electron emission at significantly lower voltages and higher electron density.

SUMMARY OF THE INVENTION

To accomplish the foregoing and other objects, features and advantages of the invention there is provided a negative glow discharge lamp that is constructed of a light transmitting envelope having supported therein electrode means for establishing a negative glow in the lamp. The improvement, in accordance with the present invention resides in providing a fill material that in particular is a metal, preferably sodium, which upon excitation thereof, directly emits visible light. This metal is selected to have a resonance radiation in the visible part of the spectrum. In order to raise the vapor pressure of the metal (e.g., sodium), the temperature of the cold spot is raised to a level in a range of 200° C.–300° C. This is preferably accomplished by making the lamp bulb smaller and thereby increasing the power loading which, in turn, raises the temperature. A lamp of the present invention is characterized by having a much higher energy conversion efficiency than its pure mercury counterpart, by virtue of the fact that no phosphor is required in the conversion process for the production of visible light in accordance with the sodium negative discharge lamp of the invention.

BRIEF DESCRIPTION OF THE DRAWINGS

Numerous other objects, features and advantages of the invention should now become apparent upon a reading of the following detailed description taken in conjunction with the accompanying drawings, in which.

DESCRIPTION OF THE PREFERRED EMBODIMENT

Figure 1:
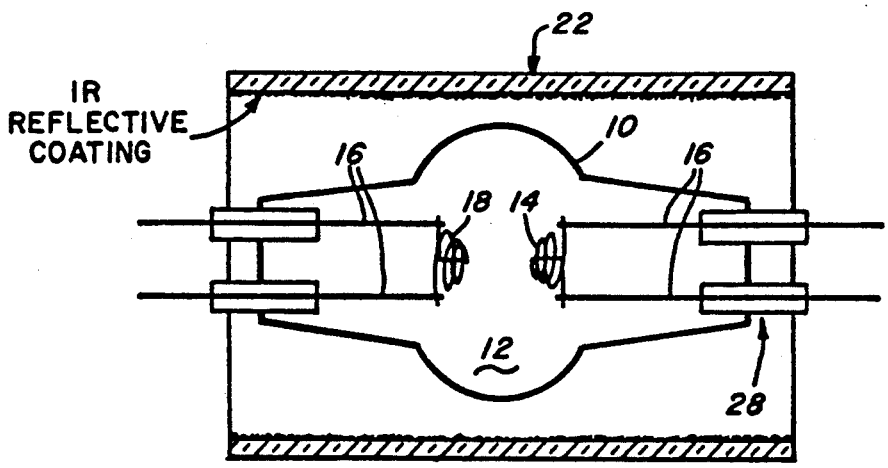
FIG. 1 is a schematic diagram of a negative glow discharge lamp constructed in accordance with the principles of the present invention.
Figure 2:
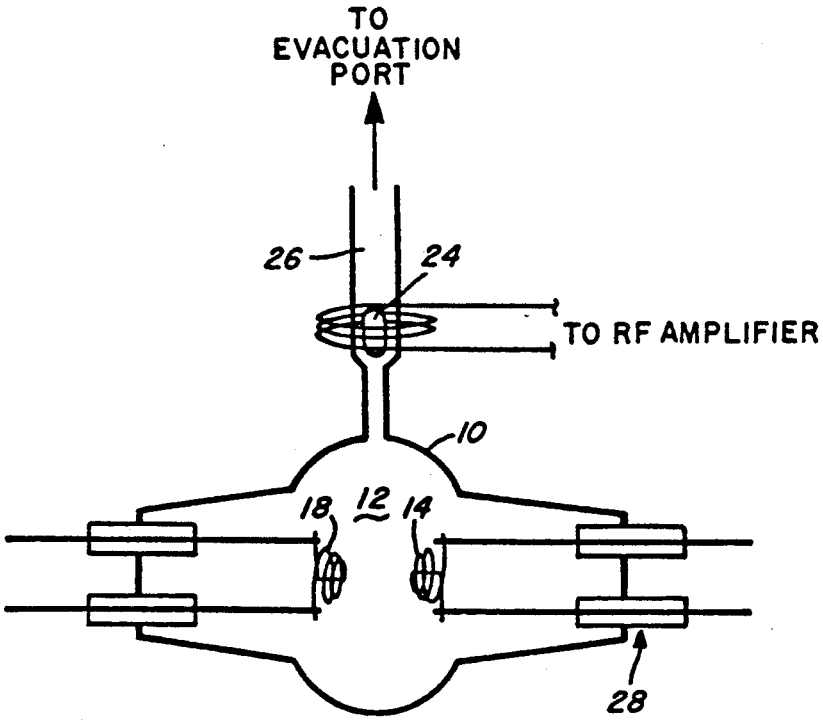
FIG. 2 illustrates an intermediate step in the fabrication of the lamp particularly relating to the filling thereof.

There is described herein, and with particular reference to FIGS. 1 and 2 herein, a discharge lamp that operates in the negative glow regime whereby the discharge gas used is a metal, preferably sodium in the presence of a rare gas such as neon. The particular fill material is one of metal, preferably having a resonance radiation in the visible part of the spectrum and whose vapor pressure is reasonably high. In this connection, previous negative glow discharge lamps have used a mercury discharge and have thus required a phosphor to convert the ultraviolet light to visible radiation.

As indicated previously, the present invention teaches the use of sodium or other appropriate metal-based gases in the negative glow regime of a gas discharge. The lamp is operated with a hot cathode. The "whitish" color emanating from the discharge due to the high energy electrons emerging from the cathode fall regime, provides a superior color rendition particularly in comparison with standard low pressure sodium lamps which radiate only monocromatic yellow radiation due to the excitation of only low energy Maxwellian electrons. On the other hand, in accordance with the present invention there are high energy electrons emerging from the cathode fall regime. These high energy electrons serve to excite the fill material which emits radiation in the visible spectrum. Because high energy electrons cause the excitation of, not only the resonance levels of sodium which emit yellow radiation, but also the higher excited levels which emit green and blue radiation, the overall effect is a whiter color, thereby rendering superior appearance.

In accordance with the present invention, the glow lamp is operated with a hot cathode. In this way, electron emission occurs at significantly lower voltages and with much higher electron density than with cold cathode operation. The high electron density makes it possible to generate a sufficient light output for the device to be of practical use. On the other hand, the cold cathode electron density is extremely low, such that at ordinary voltages (several hundred volts) the amount of light obtained is in the tens of lumens range.

Moreover, by the use of operation with a hot cathode, the electron energy distribution function (EEDF) is such that there is a significant portion of high energy electrons. These high energy electrons can, in a single step, excite the upper electronic levels of, for example, sodium which provides the blue and green photons in addition to the yellow (by cascade) so as to obtain a whiter color.

Because visible light is immediately emitted upon excitation of the fill material, the loss associated with the translation of ultraviolet radiation into visible light is avoided. The instant invention replaces the need for using a phosphor coated glass envelope, generally used with mercury negative glow discharge lamps.

It is anticipated that a lamp of this nature has a much higher energy conversion efficiency than its pure mercury counterpart, by virtue of the fact that no phosphor is required in the conversion process for the production of visible light.

As previously indicated, one of the advantages of the present invention is the broad spectral output that results. Because this is a negative glow regime of operation, the sodium discharge is "whitish." In addition to the dominant monochromatic yellow D-lines, the high energy electrons are able to excite the blue and green lines thus improving the color renditions, an effect that does not occur in the positive column.

A further advantage of the lamp of the present invention and its particular mode of operation is that one obtains larger and larger high energy electron fractures at lower rare gas pressures. Typically, at pressures of 10 or more torrs of rare gas, the electron energy distribution function (EEDF) becomes Maxwellian and the fraction of high energy electrons diminishes substantially. Therefore, it is desired to maintain the pressure below about 3 torr so as to maximize the fraction of high energy electrons and yet obtain reasonable lamp life. On the other hand, at very low pressures, cathode evaporation reduces the life and the maintenance of the lamp.

Referring to FIG. 1, a negative glow discharge lamp for DC use is shown. A lamp envelope 10 made from a light emitting sodium resistant substance, such as plyglass, defines a discharge volume 12. The discharge volume 12 contains a fill material which emits visible light upon excitation. The fill material is comprised of a metal-based gas, preferably sodium, and a noble gas. A suitable noble gas is neon. Also enclosed within the discharge volume of the lamp envelope is an anode 14, supporting leads 16, and a cathode 18. A standard electrode mount assembly 28 is used for support of the electrodes by means of the supporting leads within the envelope 10.

FIG. 1 shows the glow lamp, which in this particular embodiment is adapted for operation in the DC mode. The lamp includes, as indicated previously, the two electrodes 14 and 18, spaced closely together, separated by a distance of approximately 1.5 cm. One of the electrodes is coated with an emissive material for enhancing the thermionic discharge of electrons and acts as the cathode 18. The other electrode is left bare to serve as the anode 14. The mode of operation exhibits superior lumen maintenance and longer lifetime when compared to AC operation. Because high energy electrons emerge from this regime, a superior color rendition including blue and green lines results, as compared to standard low pressure sodium lamps which only emit monochromatic yellow radiation.

To this point the description in connection with FIG. 1 has been for a DC mode of operation. However, it is to be understood that the principles of the present invention may also be used for an AC mode of operation as well as for other modes of operation such as for pulse operation.

In order to raise the vapor pressure of the metal (e.g., sodium), the temperature of the cold spot is to be raised to a level of at least 100° C. and preferably to a level in a range of 200° C.–300° C. This can be accomplished, inter alia, by making the bulb smaller and thereby increasing the power loading which, in turn, raises the temperature. For safety considerations, it is preferred to enclose the lamp in an outer jacket which will be far cooler to the touch. In this regard, refer to FIG. 1 and the evacuated outer glass jacket 22. The jacket 22 is preferably coated with an infrared reflecting material which assists in elevating the cold spot temperature of the lamp for optimum sodium vapor pressures. These vapor pressures are typically between 1.0 and $4.0\times10^{-3}$ torr. The neon gas pressure used is between 2 and 3 torr.

The glass envelope 10 used to construct the lamp, is made from plyglass, a type of glass known to minimize sodium migration through the walls.

Previous negative glow discharge lamps have used a mercury discharge and phosphor to convert the ultraviolet radiation to visible light. As the present invention employs sodium discharge and avoids the translation step, a more efficient energy transfer results.

In connection with the mode of fabrication of a lamp in accordance with the present invention, reference can also be made to FIG. 2 which essentially shows an intermediate step in the method of manufacture, the step in particular relating to providing the sodium fill.

More particularly, FIG. 2 illustrates a pellet 24 of sodium which is placed in the exhaust tube 26 connected to the lamp envelope 10. The electrode mount assembly 28 consists of a pair of dual wafer stems, enclosing 0.01 inch diameter beaded dumet wire pieces. Attached to this are 0.02 inch diameter nickel lead-in wire pieces. Electrodes are clamped on the ends of each lead, and the distance between the electrodes is apProximately 1.5 cm. One of the coiled electrodes is coated with an emissive coating obtained from a standard mix and serves as the cathode 18; the other electrode is left free of coating and serves as the anode 14.

The lamp is then evacuated and baked in an oven to a temperature of approximately 400° C. The cathode, requiring hot temperatures for effective operation, is activated in a tightly sealed vacuum by heating it to about 1250° C. The sodium pellet 24 is melted by rapidly heating it with a radio frequency field to make it liquidous. A burst of neon gas (approximately 700 torr) is then used to force the liquidous sodium mass into the glass envelope. The lamp is then filled with 2 to 3 torr of neon gas and the lamp is tipped off. Finally, the lamp is mounted in the jacket 22 as illustrated in FIG. 1. In this connection, it is noted that the jacket 22 may or may not be used with the lamp structure.

As indicated previously, in the preferred embodiment of the invention a sodium gas is used in a negative glow regime of a gas discharge lamp. This increases the efficacy of the lamp when compared to mercury negative glow discharge lamps and provides superior color rendition when compared to standard low pressure sodium lamps.

The efficacy of the lamp is estimated to be approximately 120 lumens per watt (LPW) at an operating voltage of 11 volts and a discharge current of 2.0 amps. This is a 3 to 4 factor increase in efficacy when compared to mercury negative glow discharge lamps and thus a more efficient means of converting electrical energy to light energy.

As indicated previously, the preferred fill material is a sodium fill for the lamp, however, other metal-based gases may also be employed as long as they have a resonance radiation in the visible part of the spectrum and wherein they furthermore have a vapor pressure that is reasonably high. The vapor pressure should be no less than 6 microns at no greater than say 400–500° C. Again, although sodium is preferred, other metal based gases that can be employed include thallium and lithium or their various combinations.

In order to make an efficient sodium negative glow lamp with whiter color, it is desired to generate sufficient electrons with about 5–7 eV of energy. Generally speaking, these energy levels can only be achieved with a hot cathode under the conditions mentioned. This mode of operation provides for the generation of blue and green photons which provides the major color improvement particularly in comparison to low pressure sodium lamps.

Although a preferred embodiment of the invention has been illustrated, it will be readily apparent to those skilled in the art that various modifications may be made therein without departing from the spirit of the invention or from the scope of the appended claims. For example, the lamp could either be single-ended or double-ended.

What is claimed is:

1. In a negative glow discharge lamp including a light transmitting envelope having supported therein electrode means including a cathode for establishing a negative glow discharge in the lamp, the improvement comprises a fill material including a metal-based gas which upon excitation thereof directly emits visible light, said metal having a resonance radiation in the visible part of the spectrum, and means for operating the cathode in a hot mode to provide enhanced electron emission at enhanced electron density.

2. In a negative glow discharge lamp as set forth in claim 1 further including an evacuated outer glass jacket coated with a reflecting material to elevate the cold spot temperature of the lamp.

3. In a negative glow discharge lamp as set forth in claim 1 wherein said fill material contains sodium.

4. In a negative glow discharge lamp as set forth in claim 3 wherein said fill material also includes a noble gas.

5. In a negative glow discharge lamp as set forth in claim 4 wherein said noble gas includes neon.

6. In a negative glow discharge lamp as set forth in claim 1 wherein said electrode means comprises a pair of electrodes separated by approximately 1.5 cm.

7. In a negative glow discharge lamp as set forth in claim 2 wherein said outer glass jacket is provided with an infrared reflecting material.

8. In a negative glow discharge lamp as set forth in claim 1 wherein said light transmitting envelope is made from a glass material that minimizes sodium migration through the envelope wall.

9. In a negative glow discharge lamp as set forth in claim 1 wherein said metal based gas comprises thallium.

10. In a negative glow discharge lamp as set forth in claim 1 wherein said metal based gas comprises lithium.

11. In a negative glow discharge lamp as set forth in claim 1 wherein said cathode is operated so as to provide a cold spot temperature on the order of at least 100° C.

12. In a negative glow discharge lamp as set forth in claim 11, wherein said cold spot temperature is in a range on the order of 200° C.–300° C.

13. In a negative glow discharge lamp as set forth in claim 11 wherein said noble gas is maintained at a relatively low pressure so as to maximize the fraction of high energy electrons while maintaining a favorable life expectancy for the lamp.

14. In a negative glow discharge lamp as set forth in claim 13 wherein the vapor pressure is maintained at a pressure of 3 torr or less.

* * * * *